United States Patent [19]

Martin et al.

[11] Patent Number: 4,717,458

[45] Date of Patent: Jan. 5, 1988

[54] ZINC AND ZINC ALLOY ELECTROLYTE AND PROCESS

[75] Inventors: Sylvia Martin, Utica; Roy W. Herr, Troy; Walter J. Wieczerniak, Utica; Alice M. Strom, Warren, all of Mich.

[73] Assignee: OMI International Corporation, Warren, Mich.

[21] Appl. No.: 920,636

[22] Filed: Oct. 20, 1986

[51] Int. Cl.[4] ..... C25D 3/22; C25D 3/56

[52] U.S. Cl. ..... 204/44.2; 204/44.5; 204/55.1

[58] Field of Search ..... 204/55 R, 55 Y, 44.2, 204/44.5, 114, 123

[56] References Cited

U.S. PATENT DOCUMENTS 3,454,475 7/1969 Rushmere et al. ..... 204/55 Y 4,397,718 8/1983 Martin ..... 204/55 Y 4,401,526 8/1983 Martin ..... 204/44.2

4,444,629 4/1984 Martin ..... 204/44.2

4,488,942 12/1984 Martin et al. ..... 204/44.2

*Primary Examiner*—G. L. Kaplan

*Attorney, Agent, or Firm*—Richard P. Mueller

[57] ABSTRACT

An aqueous bath suitable for electrodepositing zinc and alloys of zinc including zinc-nickel, zinc-cobalt, zinc-nickel-cobalt, zinc-iron, zinc-iron-nickel, zinc-iron-cobalt, and zinc-nickel-cobalt-iron containing a brightening amount of an AABB-type polyamide brightener in an amount effective to produce an electrodeposit of the desired brightness. The invention further contemplates the process of electrodepositing zinc and zinc alloys of the foregoing types on a conductive substrate employing the aqueous electrolyte.

28 Claims, No Drawings

ZINC AND ZINC ALLOY ELECTROLYTE AND PROCESS

BACKGROUND OF THE INVENTION

The present invention broadly relates to an electroplating bath and process for electrodepositing zinc as well as alloys of zinc on a conductive substrate, and more particularly, to an electroplating bath and process incorporating controlled effective amounts of a bath soluble and compatible AABB-type polyamide brightening agent for enhancing the characteristics of the zinc or zinc alloy electrodeposit.

Zinc and zinc alloy electroplating baths of various types have heretofore been used or proposed for use for depositing a metal plating of a decorative or functional type on a variety of conductive substrates such as iron and steel, for example, to provide for improved corrosion resistance, enhance the decorative appearance and/or to build up the surface of a worn part enabling refinishing thereof to restore its original operating dimensions. Typically, zinc as well as alloys of zinc and nickel, zinc and cobalt and zinc, nickel and cobalt can provide decorative surface finishes of a semi-bright to a lustrous appearance while simultaneously enhancing the resistance of the substrate to corrosion. Such electroplating baths in addition to plating baths for depositing a zinc and iron alloy; a zinc, iron and nickel alloy; a zinc, cobalt and iron alloy; as well as a zinc, cobalt, nickel and iron alloy have found widespread commerical use for industrial or functional plating applications including strip plating, conduit plating, wire plating, rod plating, tube plating, coupling plating, and the like. Zinc electroplating baths can also be satisfactorily applied in processes such as electrowinning and zinc electrorefining while zinc alloys containing iron in the alloy deposit are suitable for electroforming of worn parts, for plating of soldering iron tips and for plating of Intaglio plates for printing and the like.

Typical of such prior art electrolyte compositions and processes are those described in U.S. Pat. Nos. 4,397,718; 4,401,526 and 4,488,942 which are assigned to the same assignee as the present invention. Of the foregoing United States Patents, U.S. Pat. No. 4,488,942 discloses the use of AB-type polyamide brightening agents in zinc as well as zinc alloy electrolytes to achieve improved zinc and zinc alloy electrodeposits and to further provide for an increase in the flexibility and versatility of their use in such electrolyte compositions. The AABB-type brightening agents of the present invention provide for similar advantages in flexibility and versatility of use while surprisingly increasing the codeposition of cobalt from electrolytes containing zinc and cobalt ions achieving thereby an increased cobalt content in the zinc-cobalt alloy electrodeposit employing electrolytes containing similar cobalt ion concentrations, or, providing similar cobalt contents in the zinc-cobalt alloy electrodeposit at substantially lower cobalt ion concentrations in the electrolyte. The use of the AABB-type polyamide brightening agent has also been observed to unexpectedly increase the ductility of zinc-nickel alloy electrodeposits.

The present invention is directed to an improved brightening agent or mixtures of brightening agents which can be effectively employed in zinc and zinc alloy plating baths providing improved flexibility and versatility in the use and control thereof and in the electrodeposition of zinc and zinc alloy electrodeposits possessed of the desired appearance and physical properties.

SUMMARY OF THE INVENTION

The benefits and advantages of the present invention, in accordance with the composition aspects thereof, are achieved by an aqueous bath suitable for electrodepositing zinc and zinc alloys on a conductive substrate including zinc ions present in an amount sufficient to electrodeposit zinc and, in the case of a zinc alloy, one or more additional metal ions of the group including nickel, cobalt and iron present in an amount to electrodeposit an alloy of zinc and nickel, an alloy of zinc and cobalt; an alloy of zinc, nickel and cobalt; an alloy of zinc and iron; an alloy of zinc, iron and nickel; an alloy of zinc, iron and cobalt; and an alloy of zinc, iron, nickel and cobalt. The bath further contains a brightening amount of an AABB polyamide brightener of the structural formula:

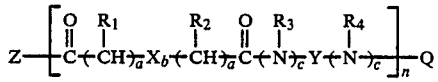

as hereinafter more fully defined.

The operating bath may range in pH from about 0 up to about 14 depending upon the specific type of bath employed as well as the particular alloy to be deposited. In the case of baths of a substantially neutral pH, the bath preferably further contains a complexing or chelating agent to retain an effective amount of the metal ions to be electrodeposited in solution. The baths further preferably contain bath soluble and compatible conductivity salts of the types conventionally employed to enhance the electrical conductivity of the bath. In zinc and zinc alloy baths for depositing a nickel and/or cobalt zinc alloy, the baths preferably further contain supplemental secondary brighteners and leveling agents as well as additives for improving the crystal structure of the electrodeposit. Buffering agents such as boric acid, for example, are also preferably included.

In accordance with the process aspects of the present invention, the electroplating bath of the foregoing composition is employed to electrodeposit zinc or a selected zinc alloy on a conductive substrate over a broad current density range with a bath temperature controlled within a prescribed range which will vary in consideration of the specific bath composition, method of electrodeposition and the particular alloy deposit and physical characteristics of the electrodeposit desired.

Additional benefits and advantages of the present invention will become apparent upon a reading of the Description of the Preferred Embodiments taken in conjunction with the specific examples provided.

DESCRIPTION OF THE PREFERRED EMBODIMENTS

The aqueous electroplating bath of the present invention for electrdepositing zinc and alloys of zinc contains a controlled amount of zinc ions and, in the case of the electrodeposition of a zinc alloy deposit, one or more additional metal ions selected from the group consistng of nickel, cobalt and iron in further combination with a AABB-type polyamide brightener of the structural formula:

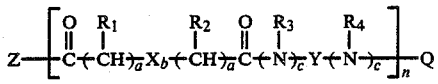

Wherein:

a is 0 or an integer of 1 to 3;

b is 0 or 1;

c is 0 or 1;

Q is H,

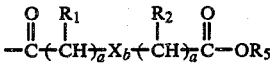

Z is —O—$R_5$,

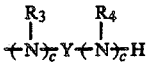

$R_1$ and $R_2$ are —H, —$CH_3$, —OH;

$R_3$ and $R_4$ are —H, $C_1$–$C_4$ alkyl group, $C_3$–$C_5$ alkenyl group, $C_3$–$C_5$ alkynyl group, —$CH_2$—$CH_2$—OH, —$CH_2$—CHOH—$CH_3$, $R_5$ is —H, $C_1$–$C_4$ alkyl group or M;

X is

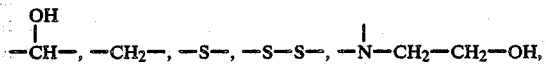

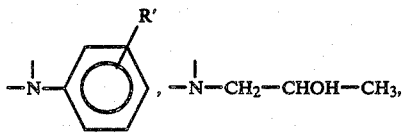

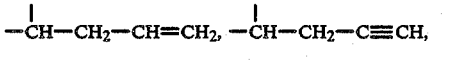

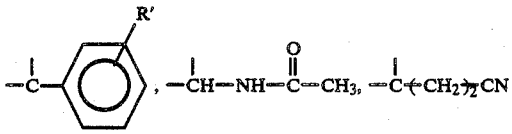

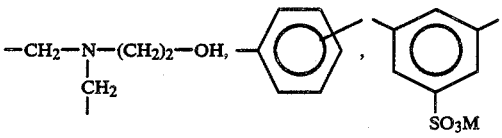

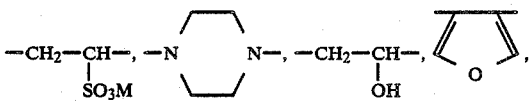

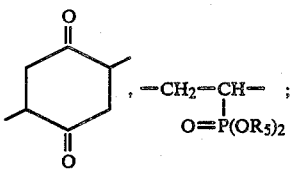

in which M is Li, Na, K, Mg, $NH_4$ and R′ is —H, —$NO_2$, —$SO_3$ M, —$CO_2$ $R_5$, —CHO, —F, —Cl, —Br, —I, $C_1$–$C_4$ alkyl group, $C_2$–$C_4$ alkenyl group, $C_2$–$C_4$ alkynyl group;

Y is

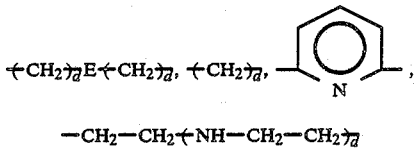

in which E is —S—, —S—S—, —O—,

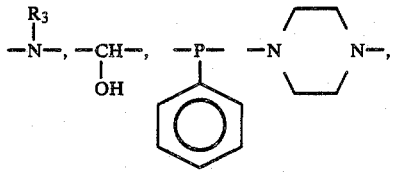

and d is 0 or an integer of 1–6;

as well as the alkylated or cross-linked derivatives and mixtures thereof.

The molecular weight of the AABB - type polyamide brightener is not believed to be critical. The polymer brightener must, however, be bath soluble which sets a functional upper limit of molecular weight or degree of polymerization. Thus, the molecular weight of the AABB - type polyamide brightener can vary from that in which "n" in the structural formula is 1 (provided the number of amide groups in the molecule is greater than 1) up to a molecular weight at which the brightener becomes bath insoluble.

The AABB - type polyamides described by the structural formula can also be cross-linked or alkylated when the polyamide contains a suitable nucleophilic group in the X or Y portion of the polyamide. Such groups are sulfide, secondary amine, tertiary amine, and tertiary phosphine groups as described in the definitions for X and Y. Typical cross-linking agents selected from the broad class of difunctional alkylating agents are dihalo-substituted organic compounds, epihalohydrins, and amine condensation products formed from the reaction of ammonia, primary amines or secondary amines, with difunctional alkylating agents. These cross-linking agents may be described by the following formulae:

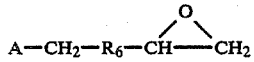

OR

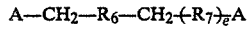

Wherein:

A is —Cl, —Br, —I,

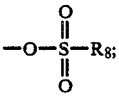

$R_6$ is

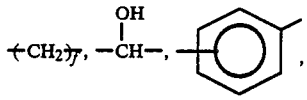

—CH=CH—, —C≡C—;

$R_7$ is —$R_9$—$CH_2$—$R_6$—$CH_2$—;

$R_8$ is —$CH_3$,

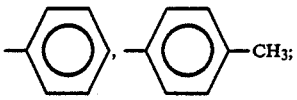

$R_9$ is

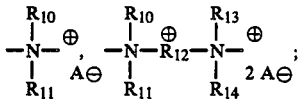

$R_{10}$, $R_{11}$, $R_{13}$ and $R_{14}$ may be same or different and are —H, —$CH_2CH_2OH$, an alkyl group of 1–4 carbons; an alkenyl or alkynyl group of 3–5 carbons;

$R_{12}$ is —$CH_2$—$CH_2$—,

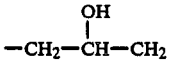

If $R_{11}$, or $R_{11}$ and $R_{14}$ are —H, then the definition of $R_9$ simplifies to;

$R_9$ is

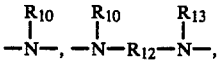

e is equal or greater than 1; and f is 0 or an integer of from 1–4;

AABB-type polyamides corresponding to the foregoing structural formula can be be synthesized by a variety of well-known methods such as disclosed in the following references:

Melvin I. Kohan, Chapter 2, "Preparation and Chemistry of Nylon Plastics", in "Nylon Plastics", edited by Melvin I. Kohan, Interscience, 1973.

Richard E. Putscher, "Polyamides (General)", in "Kirk-Othmer, Encyclopedia of Chemical Technology", Third Edition, Vol. 18, pp. 328–371, Wiley - Interscience, 1982.

Stanley R. Sandler and Wolf Karo, Chapter 4, "Polyamides", in "Polymer Syntheses", Vol. I, pp. 88–115, Academic Press, 1974.

W. Sweeny and J. Zimmerman, "Polyamides", in "Encyclopedia of Polymer Science and Technology", Vol. 10, pp. 483–597, Interscience, 1969.

The brightener additives may be obtained commercially by modification of commercially available AABB-type polyamides or by a polymerization reaction of the appropriate monomers. Both synthetic approaches are disclosed in the foregoing references. Additionally, when the additives are alkylated, typical alkylating agents which may be used are dimethyl sulfate methyl halides, allyl halides, propargyl halides and benzyl halides.

In addition to the zinc ions and any other metal ions present in further combination with the AABB-type polyamide brightening agent, the electroplating bath may further contain, as an optional but preferred ingredient, conventional bath soluble and compatible conductivity salts including ammonium sulfate, ammonium chloride, ammonium bromide, sodium chloride, potassium chloride, ammonium fluoroborate, magnesium sulfate, sodium sulfate, and the like to increase the electrical conductivity of the bath. Additionally, the electroplating baths contain various conventional buffering agents such as boric acid, acetic acid, benzoic acid, salicylic acid, ammonium sulfate, sodium acetate, and the like. The electroplating baths further contain appropriate concentrations of hydrogen ions or hydroxyl ions to provide an appropriate acidic, substantially neutral or an alkaline bath as may be desired and as subsequently described in further detail.

ZINC ELECTROPLATING BATH

Suitable electroplating baths for depositing decorative and industrial or functional deposits consisting essentially of zinc can be formulated as an acid bath (pH about 0 to about 6), an alkaline bath (pH about 9 to about 14) and a substantially neutral bath (pH about 6 to about 9). Acid zinc plating baths can be formulated in accordance with conventional practice by introducing a zinc salt such as a sulfate, fluoborate, chloride or sulfamate in an aqueous solution along with a noncomplexing acid such as sulfuric acid, fluoboric acid, hydrochloric acid or sulfamic acid. Mixtures of zinc salts, for example, zinc sulfate and zinc chloride can be employed if desired. Acid zinc plating baths can also be based on zinc acetate.

Acid zinc electroplating baths can also contain various other additives or agents. In some cases, a particular additive or agent may be useful for more than one purpose. Examples of such optional additional ingredients which can be employed include buffers and bath modifiers such as boric acid, acetic acid, benzoic acid, salicylic acid, ammonium chloride and the like. Carriers, such as polyalkoxylated alkanols, hydroxyaryl compounds, acetylenic glycols, carboxy polyoxy compounds and sulfated polyoxy compounds, or sulfonated naphthalene derivatives can be used. Aromatic carbonyl compounds or nicotinate quaternaries may also be used to enhance leveling and brightness. Additional additives such as aluminum sulfate, dextrin, licorice, glucose, polyacrylamides, thiourea and derivatives thereof and the like may also be included in the bath to improve the crystal structure of the zinc electrodeposit obtained and to provide for a wider operating current density range.

Alkaline cyanide-free zinc baths are usually formed from a zinc salt such as an oxide or sulfate salt and a strong base such as sodium or potassium hydroxide. The predominant zinc species in the bath at high pH ranges is the zincate anion. It will be appreciated that as used herein, the term "zinc ion" includes zincate or other ionic species of zinc useful in electroplating baths for electroplating metallic zinc therefrom. Cyanide containing alkaline baths are usually formed from a zinc salt such as zinc oxide, a strong base such as sodium or potassium hydroxide, and varying amounts of sodium or potassium cyanide. Both cyanide-containing and cyanide-free, alkaline baths are well known in the art and have been commonly used for years.

In addition to the above mentioned ingredients, alkaline zinc plating baths may contain various additional ingredients. For example, alkaline zinc plating baths may contain buffers such as sodium or potassium carbonates. Also, aromatic aldehydes, nicotinate quaternaries, polyvinyl alcohol, animal glue or gelatin may be added to the baths for various purposes as is well known in the art.

The pH of the various zinc electroplating baths can be adjusted by the addition of a suitable agent such as the parent acid of the zinc salt in the bath, ammonium hydroxide, sodium or potassium carbonate, zinc carbonate, sodium or potassium hydroxide, boric acid or the like.

The concentration of the zinc ions in the bath can vary in accordance with conventional prior art practices. Generally, the zinc ion concentration can range from about 4 up to about 250 g/l with concentrations of about 8 to about 165 g/l being preferred. For acid zinc electroplating baths at a pH of about 0 to about 6, zinc ion concentrations of about 60 to about 165 g/l are preferred. For alkaline zinc electroplating baths at a pH of about 9 to about 14, a zinc ion concentration of about 8 to about 11 g/l is preferred. For neutral zinc electroplating baths, at a pH of about 6 to about 9, a zinc ion concentration ranging from about 30 to about 50 g/l is preferred. When neutral zinc electroplating baths are employed, it is preferred to incorporate one or a combination of complexing or chelating agents in a concentration sufficient to maintain an effective amount of zinc ions in solution to provide a desired deposit. Such chelating agents may comprise any of the types conventionally employed including acids such as citric, gluconic, glucoheptonoic, tartaric as well as the alkali metal, ammonium, zinc and other bath soluble and compatible salts thereof. Triethanolamine can also be employed.

The AABB-type polyamide brightener can be employed over a broad range of concentrations ranging up to a maximum corresponding to the limit of its solubility in the electroplating bath. The minimum concentration will vary depending upon the specific additive and related factors such as the current density of the plating process employed. Generally speaking, the brightener is employed at a concentration sufficient to obtain the brightening effect desired. For most common purposes, the brightening additive will be present in the bath at a concentration from about 0.015 to about 3.5 g/l. However, at very low current density rates, the additive can be effective in very small amounts such as, for example, at 1 mg/l and at very high current density rates at concentrations as high as 10 g/l.

In accordance with the method of the present invention, a zinc deposit is electrodeposited from a zinc electroplating bath comprising the above described brightening additive in an amount effective to obtain a desirable zinc deposit. The process of zinc plating of the present invention is useful for decorative or industrial zinc plating such as electrowinning, electrorefining, strip plating, conduit plating, wire plating, rod plating, tube or coupling plating, and so forth. Each application will require a specific form of electrolyte to be used.

The electrodeposition of zinc from the bath is carried out in the older conventional or newer high speed functional methods with average cathode current densities of 100–2000 amperes per square foot (ASF). The electroplating baths of the present invention may be used over a wide range of operating conditions since the brightening additives of the present invention can enhance the deposit of a ductile bright zinc plate over a wide range of pH, temperature and current density conditions. In addition, it is an advantage of the present invention that the brightening agents have a long working life and hence, baths of this invention can be economically employed.

Generally, the zinc plate will be electrodeposited from the zinc electroplating bath using an average cathode current density of from about 1 to 10,000 ASF with bath temperatures within the range of from about 50° F. to about 160° F. The maximum cathode current density applicable is dependent upon the particular type of zinc electrolyte employed. The bath may be agitated with air or agitated mechanically during plating or the workpieces may themselves be mechanically moved if such is desired. Alternatively, the plating solution may be pumped to create turbulence.

The zinc plate produced by the method of the present invention is normally ductile and bright. However, it will be appreciated that some platers may only desire a semi-bright zinc plate, making it possible to use only an amount of brightener effective to make a semi-bright zinc plate, thus economizing on the amount of brightener employed.

ZINC-NICKEL AND/OR COBALT ELECTROPLATING BATH

Zinc alloy baths of the present invention can comprise any of the ingredients necessarily employed in zinc alloy electroplating baths. Zinc alloy electroplating baths of different types generally speaking contain zinc ions in combination with either nickel ions or cobalt ions or a mixture of nickel ions and cobalt ions to provide the desired zinc-nickel, zinc-cobalt or zinc-nickel-cobalt alloy deposit or plate upon electrodeposition.

Zinc ions, in accordance with conventional practice, can be introduced into the aqueous solution in the form of an aqueous soluble zinc salt, such as zinc sulfate, zinc chloride, zinc fluoroborate, zinc sulfamate, zinc acetate, or mixtures thereof to provide an operating zinc ion concentration ranging from about 15 g/l to about 225 g/l with concentrations of about 20 g/l up to 100 g/l being preferred. The nickel and/or cobalt ions, also in accordance with conventional practice, can be introduced into the aqueous solution in the form of the aqueous soluble salt of nickel or cobalt such as the chloride, sulfate, fluoborate, acetate, or sulfamate salts or mixtures thereof. Either, or a combination of both, nickel and cobalt ions can be used herein. To produce an alloy deposit containing about 0.1 percent to about 30 percent of each of nickel and/or cobalt, each should be employed in the bath in amounts of from about 0.5 g/l to about 120 g/l. Preferably, the alloy deposit contains from about 0.25 percent to about a total of 20 percent of both nickel and/or cobalt, and the bath contains nickel and/or cobalt ion in an amount of from about 4 g/l to about 85 g/l respectively.

Zinc alloy baths may also contain various other additives or agents. In some cases a particular additive or agent may be useful for more than one purpose. Examples of additional ingredients which may be employed in the zinc alloy baths include buffers and bath modifiers such as boric acid, acetic acid, ammonium sulfate, sodium acetate, ammonium chloride and the like. For chloride containing baths, carriers such as polyalkoxylated ethers such as alcohols, phenols, napthols or acetylenic glycols and their anionic and cationic derivatives may be added. Aromatic carbonyl compounds such as benzylidene acetone, chlorobenzaldehyde, cinnamic acid, benzoic acid, or nicotinic acid may also be used to enhance leveling and brightness. Additionally, to further enhance brightness, sulfonimides and sulfonimides can be employed in chloride and/or sulfate containing baths of the types described in copending U.S. patent application Ser. No. 850,465, filed Apr. 15, 1986, the teachings of which are incorporated herein by reference. Zinc alloy baths may also contain conductive salts, such as ammonium sulfate, ammonium chloride, sodium and/or potassium chloride, ammonium fluoroborate, magnesium sulfate, sodium sulfate, and the like, to improve the conductivity of the bath. Additional supportive additives such as aluminum sulfate, polyacrylamides, thioureas, or the like may also be added to the bath to improve the crystal structure of the zinc alloy plate obtained and provide the desired appearance to the alloy deposit. Neutral baths may contain common chelating agents to keep the metal ions in solution. The preferred chelating agents are citric acid, gluconic acid, glucoheptanoic acid, tartaric acid as well as their alkali metal, ammonium, zinc, cobalt, or nickel salts. Also triethanolamine may be used. The quantities used should be enough to keep the metals in solution at pH 6–8.9.

The pH of the zinc alloy bath is preferably adjusted by employing an acid corresponding to the zinc salt used. Thus, depending upon the particular zinc salt in the bath, sulfuric acid, hydrochloric acid, fluoroboric acid, acetic acid, sulfamic acid, or the like, can be added to the bath to provide an operating pH of from about 0 up to about 6 for acid baths, preferably from about 0.5 up to about 5.5. For neutral baths of pH about 6–8.9, complexing agents have to be used and the pH can be adjusted via alkaline metal or ammonium hydroxides or carbonates.

It is also contemplated that the bath of the present invention can further incorporate controlled amounts of other compatible brightening agents of the types that could be employed in zinc alloy plating solutions. Included among such supplemental and optional brightening agents are aromatic carbonyl compounds, thioureas or N-substituted derivatives thereof, cyclic thioureas, polyacrylamides, and other well known additives such as those described in U.S. Pat. No. 4,401,526, the teachings of which are incorporated herein by reference, and the like.

In addition, aluminum ion can be introduced into the bath by an aqueous soluble salt thereof, such as aluminum sulfate, to obtain an enhanced brightening effect. Aluminum ion can suitably be employed in a concentration of from about 0.5 mg/l up to about 200 mg/l, preferably from about 4 mg/l up to about 40 mg/l.

To further enhance the corrosion resistance of the alloy deposit, small amounts of trace metals which will codeposit with the zinc alloy may be added to the electroyte. For example, soluble salts of chromium, titanium, tin, cadmium, or indium may be added to the bath in amounts of 5 mg/l to 4 g/l.

In addition to the foregoing bath ingredients, the zinc alloy plating bath contains an effective amount of the AABB-type polyamide brightener or mixtures thereof present in the same concentrations as previously described in connection with the zinc electroplating bath including permissible variations of as low as about 1 mg/l under plating processes employing very low current density rates to as high as about 10 g/l employing very high current density rates with 0.015 to about 3.5 g/l being preferred.

In accordance with the method of the present invention, a zinc alloy deposit is electrodeposited from a zinc alloy electroplating bath comprising the above described brightening additive in an amount effective to obtain a desirable zinc alloy deposit. The process of zinc alloy plating of the present invention is useful for decorative or functional zinc alloy plating such as strip plating, conduit plating, wire plating, rod plating, tube or coupling plating, and so forth. Each application will require a specific form of electrolyte to be used depending on what corrosion protection or properties are desired.

Zinc alloy plating baths of the present invention can be employed over a broad range of temperatures. In use, the temperature of operation of the bath is normally between about 60° F. and 160° F. and even up to 170° F. and typically, between 65° F. and 120° F.

The electrodeposition of zinc alloy from the bath can be carried out in the older conventional or newer high speed functional methods. The electroplating baths of the present invention may be used over a wide range of operating conditions since the brightening additives of the present invention can enhance the deposit of the semi-bright to bright zinc alloy plate over a wide range of pH, temperature and current density conditions. In addition, it is an advantage of the present invention that the brightening agents have a long working life and hence, baths of this invention can be economically employed.

Generally, the zinc alloy plate will be electrodeposited from the zinc alloy electroplating bath using an average cathode current density of from about 3 to 5,000 ASF with bath temperature within the range of from about 65° F. to about 160° F. The maximum cathode current density applicable is dependent upon the particular type of zinc alloy electrolyte employed. The bath may be agitated with air or agitated mechanically during plating or the workpieces may themselves be mechanically moved if such is desired. Alternatively, the plating solution may be pumped to create turbulence.

ZINC-IRON ALLOY ELECTROPLATING BATH

The AABB-type polyamide brightener is also suitable for use in aqueous electroplating baths containing zinc ions and iron ions for electrodepositing a zinc-iron alloy as well as a bath further containing nickel ions and/or cobalt ions for electrodepositing a corresponding zinc-iron-nickel alloy; a zinc-iron-cobalt alloy; or a zinc-iron-nickel-cobalt alloy. Besides the AABB-type polyamide brighteners such alloy electroplating baths can contain any of the ingredient, conventionally employed in accordance with prior art practices.

The iron ions can be introduced into the aqueous solution in the form of aqueous soluble iron salts, such as iron sulfate, iron chloride, iron fluoborate, iron sulfamate, iron acetate, or mixtures thereof to provide an operating iron ion concentration ranging from about 5 g/l up to about 140 g/l with concentrations of about 40 g/l up to about 100 g/l being preferred. The zinc ions as well as any nickel or cobalt ions can be introduced in the bath employing bath soluble and compatible salts of the types previously described in connection with the electroplating bath for depositing zinc-nickel and/or cobalt alloys.

To produce an alloy deposit containing about 5 percent to about 96 percent of zinc, the zinc ions should be employed in the bath in amounts of about 2 g/l to about 120 g/l. Preferably, the zinc-iron alloy deposit contains from about 10 percent to about 90 percent zinc and the bath preferably contains zinc ions at a concentration of from about 7 to about 75 g/l.

The electroplating bath may optionally but preferably, further contain buffering agents and conductivity salts of the types hereinbefore described.

The zinc-iron alloy electroplating bath can range in pH from about 0 up to about 6.5, preferably from about 0.5 to about 5. When the bath is weakly acidic or near neutral, such as at a pH of about 3 to about 6.5, it is preferred to incorporate conventional complexing or chelating agents to maintain an effective amount of the metal ions in solution. The preferred chelating or complexing agents are citric acid, gluconic acid, glucoheptanoic acid, tartaric acid, ascorbic acid, isoascorbic acid, malic acid, glutaric acid, muconic acid, glutamic acid, glycollic acid, aspartic acid, and the like as well as their alkali metal, ammonium, zinc or ferrous salts thereof. Additionally, suitable complexing or chelating agents that can be employed include nitrilo triacetic acid, ethylene diamine tetraethanol and ethylene diamine tetra acetic acid and salts thereof.

The presence of excessive amounts of ferric ions in the electroplating bath is objectionable due to the formation of striations in the plated surface. For this reason, it is desirable to control the ferric ion concentration at a level usually less than about 2 g/l. Although the iron constituent of the bath is normally introduced as ferrous ions, some oxidation of the ferrous ions to the ferric state occurs during the operation of the bath. It has been found that a control of the ferric iron formation to within acceptable levels is achieved by employing a soluble zinc anode in the electroplating bath or, alternatively, by immersing metallic zinc in the holding tank through which the electroplating solution is circulated. In the event no soluble anodes are employed in the electroplating process or no zinc metal is provided in the holding tank, appropriate control of the ferric ion concentration can be achieved employing suitable bath soluble and compatible organic and/or inorganic reducing agents such as, for example, bisulfite, isoascorbic acid, monosaccharides and disaccharides such as glucose or lactose.

The bath can also optionally contain appropriate concentrations of nickel ions and/or cobalt ions to provide a ternary alloy of zinc-iron-nickel; zinc-iron-cobalt; or a quaternary alloy of zinc-iron-nickel-cobalt. The cobalt and nickel ions can be introduced as in the case of the zinc-nickel or zinc-cobalt alloys and their concentration is preferably controlled so as to provide an alloy containing from about 1 percent to about 20 percent of iron with either about 0.1 to about 2 percent cobalt or about 0.1 to about 20 percent by weight nickel and the balance essentially zinc, or a quaternary alloy containing 1 percent to about 20 percent iron, 0.1 to about 10 percent cobalt, 0.1 to about 20 percent nickel and the balance about 55 to about 98.8 percent zinc.

In addition to the foregoing, the bath further contains the AABB-type polyamide brightener at a concentration equivalent to that employed for plating zinc-cobalt or zinc-nickel alloys with a concentration of from about 0.01 up to about 3.5 g/l being preferred for most common purposes. Higher and lower concentrations as previously described can be employed in consideration of the plating process and the current densities employed.

In accordance with the process aspects of the present invention, the zinc-iron alloy or zinc-iron and nickel or cobalt alloy is deposited and has utility as an industrial or functional plating such as for strip plating, conduit plating, wire plating, rod plating, tube or coupling plating, electroforming build up of worn parts, plating of soldering iron tips, plating of Intaglio plates for printing or the like. Zinc-iron alloy plating baths generally operate at temperatures of about 60° to about 160° F. and preferably about 65° to about 95° F.

Generally, the zinc-iron alloy is electrodeposited using an average cathode current density of about 10 to about 5,000 ASF at bath temperatures of about 65° to about 160° F. The maximum cathode current desity applicable is dependent upon the particular type of deposit desired. The bath is preferably agitated mechanically during the plating operation since air agitation has a tendency to increase the concentration of ferric ions in the bath.

In order to further illustrate the composition and process of the present invention, the following examples are provided. It will be understood that the examples are provided for illustrative purposes and are not intended to be limiting of the scope of the present invention as herein described and as set forth in the subjoined claims.

EXAMPLE 1

An aqueous electrolyte is prepared of the sulfate-type suitable for electrodepositing zinc containing 187 g/l zinc sulfate monohydrate, 23 g/l boric acid and 1.5 g/l poly [(diethyl-2-(2-cyanoethyl) malonate)-co-(aminoethyl ethanolamine)] as the AABB-type polyamide brightening agent. The electrolyte has a pH of about 4 and is controlled at a temperature of about 80° F. A cleaned steel panel is immersed in the electrolyte employing a zinc anode at an average cathode current density of about 80 ASF. Air agitation is employed.

The resultant panel is observed to have a bright zinc electrodeposit thereover.

EXAMPLE 2

An aqueous electrolyte is prepared of the fluoborate type suitable for electrodepositing zinc, containing 206 g/l zinc fluoborate and 1.6 g/l of poly [(diethyl succinate)-co-(amino ethylethanolamine)] as the brightening agent. The bath has a pH of about 3 and is controlled at a temperature of about 120° F.

A cleaned steel panel is immersed in the electrolyte in the presence of air agitation employing a zinc anode and is electroplated at an average current density of about 100 ASF. The resultant panel is observed to have a bright zinc electroplate thereover.

EXAMPLE 3

An aqueous electrolyte is prepared of the chloride-type suitable for electrodepositing zinc containing 110 g/l zinc chloride, 210 g/l ammonium chloride and 1.4 g/l of poly [(N,N bis(ethyl-3-propanoyl)-N-(2-hydroxyethyl)amine-co-(aminoethyl-ethanolamine)] as the brightening agent. The electrolyte is controlled at a temperature of about 75° F. and has a pH of about 5.2. A cleaned steel panel is immersed in the electrolyte in the presence of air agitation and is electroplated employing a zinc anode at an average cathode current density of about 30 ASF. The resultant plated panel is observed to have a fine grained, semi-bright zinc deposit thereover.

EXAMPLE 4

An aqueous electrolyte is prepared of the zincate type suitable for electrodepositing zinc containing 10 g/l zinc oxide, 80 g/l sodium hydroxide, 30 g/l sodium bicarbonate and 2.8 g/l of poly [(N,N-bis(ethyl-3-propanoyl)-N-(2-hydroxyethyl)-amine -co- (aminoethylethanolamine)] as the brightening agent. A Hull Cell panel is plated at 2 amps for a period of 5 minutes at an electrolyte temperature of about 75° F. The average cathode current density on the panel ranged from about 1 to about 80 ASF. The resultant panel after plating was observed to have a fine-grained and bright zinc electrodeposit.

EXAMPLE 5

An aqueous alkaline zinc cyanide electrolyte is prepared suitable for electrodepositing zinc containing 45 g/l zinc oxide, 67 g/l sodium hydroxide, 88.5 g/l sodium cyanide and 2.7 g/l of poly [(diethyl-2-(2-cyanoethyl) malonate)-co-(aminoethylethanolamine)] as the brightening agent.

A Hull Cell panel is plated at 2 amps for a period of 5 minutes at an electrolyte temperature of about 78° F. The average cathode current density over the panel ranged from about 1 to about 80 ASF. The resultant test panel had a fine-grained and bright zinc deposit thereover.

EXAMPLE 6

An acidic electrolyte is prepared suitable for electrodepositing a zinc-nickel alloy containing 80 g/l zinc sulfate monohydrate, 50 g/l nickel sulfate hexahydrate, 38 g/l boric acid, 30 g/l ammonium sulfate and 0.5 g/l of poly [(dimethyl-5-sulfoisophthalate)-co-(bis-3-aminopropylpiperazine)] as the brightening agent. The electrolyte had a pH of 4.5 and was controlled at a temperature of 85° F.

A cleaned steel panel is immersed in the electrolyte in the presence of air agitation and is electroplated at an average cathode current density of about 125 ASF. The resultant panel was inspected and exhibited a fully bright zinc-nickel alloy deposit which upon analysis was found to contain 3 percent by weight nickel.

EXAMPLE 7

An aqueous acidic electrolyte of the sulfate-type is prepared suitable for electrodepositing a zinc-nickel alloy containing 75 g/l zinc sulfate monohydrate, 300 g/l nickel sulfate hexahydrate, 2% by volume sulfuric acid and 20 mg/l of poly [(diethylsuccinate)-co-(piperazine)] as the brightening agent. The electrolyte was controlled at a temperature of about 150° F.

A steel strip passing at a speed of 300 feet per minute through the electrolyte was electroplated employing the foregoing electrolyte at an average cathode current density of about 1000 ASF. An inspection of the electroplated steel strip revealed a commercially acceptable semi-bright zinc-nickel alloy of a thickness of 0.2 mil having good appearance and ductility. Upon analysis the alloy contained 13% by weight nickel.

EXAMPLE 8

An aqueous electrolyte is prepared suitable for electrodepositing a zinc-nickel alloy containing 120 g/l zinc chloride, 26 g/l nickel chloride hexahydrate, 1.5 percent by volume of acetic acid and 0.5 g/l of poly [(diethyl succinate)-co-(aminoethylethanolamine)] as the brightening agent. The electrolyte has a pH of about 3.5 and was controlled at a temperature of about 95° F.

A cleaned steel strip was electroplated by continuous movement through the electrolyte at a speed of 400 feet per minute at an average cathode current density of about 200 ASF. The resultant plated strip was observed to have a fine-grained, semi-bright zinc alloy deposit thereon which upon analysis contained 1.6 percent by weight nickel.

EXAMPLE 9

An aqueous electrolyte is prepared suitable for electrodepositing a zinc-cobalt alloy containing 20 g/l cobalt sulfate heptahydrate, 31 g/l zinc sulfate monohydrate, 60 g/l sodium glucoheptonate, 0.4% by volume triethanolamine and 1 g/l of poly [(diethylmalonate)-co-(methyliminobis propylamine)] as the brightening agent. The electrolyte was controlled at a temperature of about 78° F. and had a pH of about 8.7.

A nickel plated steel Hull Cell panel is plated in a Hull Cell at 2 amperes for a period of 5 minutes. The electroplated panel is fully bright and has a very attractive color. Upon analysis, the zinc-cobalt alloy contained 0.5% by weight cobalt.

EXAMPLE 10

An aqueous acidic electrolyte of the sulfate-type is prepared suitable for depositing a zinc-cobalt alloy containing 57 g/l cobalt sulfate heptahydrate, 470 g/l zinc sulfate monohydrate, 1.5% by volume sulfuric acid and 0.3 g/l of poly [(diethyl succinate)-co-(N,N'bis-3-aminopropyl-piperazine)] as the brightening agent. The electrolyte is controlled at a temperature of about 110° F.

A cleaned steel strip is plated by passage through the electrolyte at a speed of 500 feet per minute at an average cathode current density of 1000 ASF. The resultant electroplated strip was observed to have a fine-grained, semi-bright and fully ductile zinc-cobalt alloy thereon. Upon analysis, the zinc-cobalt alloy contained 0.3% by weight cobalt.

EXAMPLE 11

An aqueous acidic electrolyte of the sulfate-type is prepared suitable for electrodepositing a zinc-iron alloy containing 130 g/l zinc sulfate monohydrate, 370 g/l ferrous sulfate heptahydrate, and 50 mg/l of poly [(diethyl adipate)-co-(diethylenetriamine)] as the brightening agent. The electrolyte is controlled at a temperature of about 120° F. and has a pH of about 2.

A cleaned steel strip is electroplated by passage through the electrolyte at a speed of 300 feet per minute at an average cathode current density of about 500 ASF. The electroplated strip is observed to have a semi-bright, adherent zinc-iron electrodeposit thereon with good painting properties. Upon analysis, the zinc-iron alloy contains 15% by weight iron.

EXAMPLE 12

An aqueous acidic electrolyte of the sulfate-type is prepared suitable for electrodepositing a zinc-nickel-cobalt alloy containing 100 g/l zinc sulfate monohydrate, 50 g/l cobalt sulfate heptahydrate, 50 g/l nickel sulfate hexahydrate and 100 mg/l of poly [(dimethyl-5-sulfo isophthalate)-co-(bis-3-amino propyl piperazine)] as the brightening agent. The electrolyte has a pH of about 2 and is controlled at a temperature of about 120° F.

Cleaned steel tubing is electroplated by passage through the electrolyte at a speed of 400 feet per minute at an average cathode current density of about 1000 ASF. The plated steel tubing had an attractive electrodeposit thereon which was commercially acceptable. Upon analysis, the zinc-nickel-cobalt alloy electrodeposit contained 4% by weight nickel, 0.25% by weight cobalt and the balance zinc.

EXAMPLE 13

An aqueous acidic electrolyte of the sulfate-type is prepared suitable for electrodepositing a zinc-nickel-cobalt-iron alloy containing 100 g/l zinc sulfate monohydrate, 50 g/l cobalt sulfate heptahydrate, 50 g/l nickel sulfate hexahydrate, 100 g/l ferrous sulfate heptahydrate and 150 mg/l poly[(diethyl adipate)-co-(diethylene triamine)] as the brightening agent. The electrolyte has a pH of about 2 and is controlled at a temperature of about 122° F.

A cleaned steel strip passing through the electrolyte at a speed of 300 feet per minute is electroplated at an average cathode current density of about 1,000 ASF to a thickness of 0.25 mils. The electroplated strip is observed to have a semi-bright, fine-grained, commercially acceptable deposit. Upon analysis, the alloy contained 9.9 percent cobalt, 9.5 percent nickel, 19.5 percent iron and the balance zinc.

EXAMPLE 14

An aqueous acidic electrolyte of the sulfate-type is prepared suitable for electrodepositing zinc containing 500 g/l zinc sulfate monohydrate, 4 percent by volume sulfuric acid and 0.5 g/l of a poly [(diethyl adipate)-co-(diethylene triamine)] cross-linked with epichlorohydrin and dimethylamine as the brightening agent. The electrolyte was controlled at a temperature of 110° F.

A cleaned steel strip passing through the electrolyte at a speed of 200 feet per minute is electroplated at an average cathode current density of about 1,000 ASF. The electroplated strip is observed to have a fully bright and adherent zinc deposit.

EXAMPLE 15

An aqueous acidic electrolyte of the sulfate-type is prepared suitable for electrodepositing a zinc-cobalt alloy containing 60 g/l cobalt sulfate heptahydrate, 100 g/l zinc sulfate monohydrate and 1.3 percent by volume sulfuric acid devoid of any brightening additive agents.

A cleaned steel strip passing through the electrolyte at a speed of 250 feet per minute is electroplated at an average cathode current density of 1,000 ASF and at an electrolyte temperature of about 110° F. The resultant zinc-cobalt alloy deposit upon analysis contains about 0.1 percent by weight cobalt.

EXAMPLE 16

To the electrolyte as described in Example 15, 0.5 g/l of a brightening agent is added comprising poly[(diethyl malonate)-co-(methyl iminobispropylamine)]. A cleaned steel strip is electroplated under the same conditions as described in Example 15. The resultant zinc-cobalt alloy contains an increased cobalt content in the alloy of about 0.6 percent by weight. In view of the increase in the cobalt concentration of the alloy produced in Example 16 in comparison to the alloy composition produced in accordance with Example 15, the corrosion resistance of the zinc-cobalt alloy is substantially increased.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous bath suitable for electrodepositing zinc and zinc alloys on a conductive substrate comprising zinc ions present in an amount sufficient to electrodeposit zinc, and in the case of a zinc alloy, additional metal ions selected from the group consisting of nickel, cobalt and iron present in an amount to electrodeposit an alloy of zinc and nickel, zinc and cobalt; zinc, nickel and cobalt; zinc and iron; zinc, iron and nickel; zinc, iron and cobalt; and zinc, iron, nickel and cobalt; and a brightening amount of a bath soluble AABB-type polyamide brightener of the structural formula;

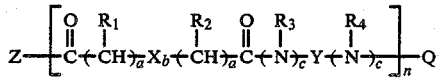

Wherein:

a is 0 or an integer of 1 to 3;

b is 0 or 1;

c is 0 or 1;

n is at least 1;

Q is H,

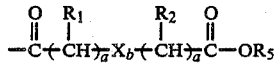

Z is —O—$R_5$,

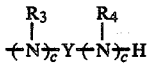

$R_1$ and $R_2$ is —H, —$CH_3$, —OH;

$R_3$ and $R_4$ is —H, $C_1$–$C_4$ alkyl group, $C_3$–$C_5$ alkenyl group, $C_3$–$C_5$ alkynyl group, —$CH_2$—$CH_2$—*OH*, —*CH*2—CHOH—$CH_3$, $R_5$ is —H, $C_1$–$C_4$ alkyl group or M;

X is

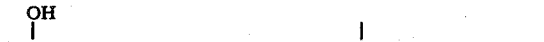

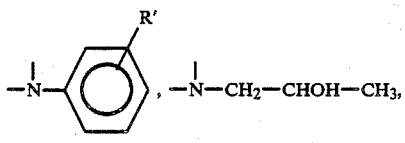

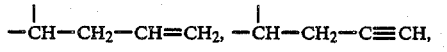

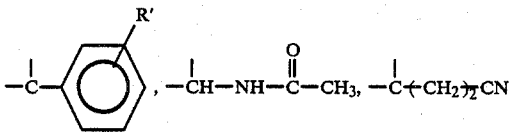

-continued

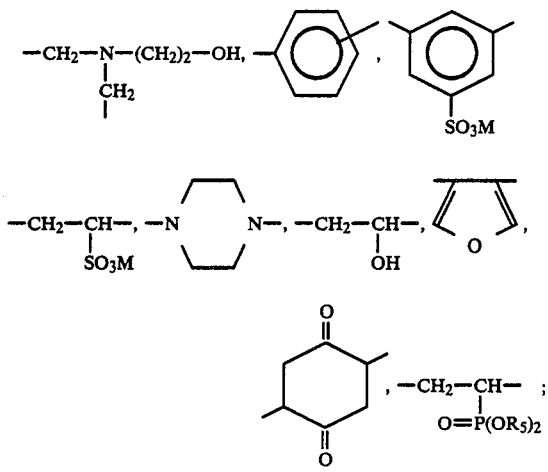

in which M is Li, Na, K, Mg, $NH_4$ and R' is —H, —$NO_2$, —$SO_3M$, —$CO_2R_5$, —CHO, —F, —Cl, —Br, —I, $C_1$-$C_4$ alkyl group, $C_2$-$C_4$ alkenyl group, $C_2$-$C_4$ alkynyl group;

Y is

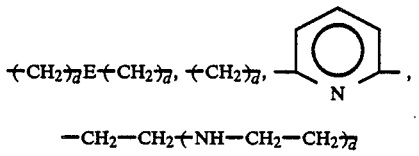

in which E is —S—, —S—S—, —O—,

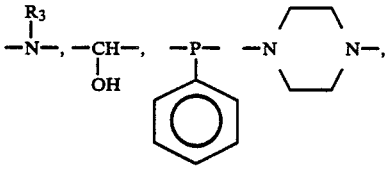

and d is 0 or an integer of 1-6;

as well as the alkylated or cross-linked derivatives and mixtures thereof, the type and number of constituent groups being selected so that said polyamide always contains at least two amide groups.

2. The bath as defined in claim 1 in which said brightener is present in an amount of about 1 mg/l to about 10 g/l.

3. The bath as defined in claim 1 further including a buffering agent.

4. The bath as defined in claim 1 further including bath soluble and compatible conductivity salts for increasing the electrical conductivity of said bath.

5. The bath as defined in claim 1 further including a complexing agent present in an amount sufficient to retain an effective amount of zinc ions and any other metal ions present for codeposition in solution.

6. The bath as defined in claim 1 in which said brightener is present in an amount of about 0.01 to about 3.5 g/l.

7. The bath as defined in claim 1 containing essentially zinc ions present in an amount of about 4 to about 250 g/l.

8. The bath as defined in claim 1 containing essentially zinc ions present in an amount of about 8 to about 165 g/l.

9. The bath as defined in claim 1 containing essentially zinc ions in an amount of about 60 to about 165 g/l and further including hydrogen ions to provide a pH of about 0 to about 6.

10. The bath as defined in claim 1 containing essentially zinc ions in an amount of about 30 to about 50 g/l and further including hydrogen ions or hydroxyl ions to provide a pH of about 6 to about 9.

11. The bath as defined in claim 10 further including a complexing agent present in an amount sufficient to retain an effective amount of zinc ions in solution.

12. The bath as defined in claim 1 containing essentially zinc ions in an amount of about 8 to about 11 g/l and further including hydroxyl ions to provide a pH of about 9 to about 14.

13. The bath as defined in claim 1 containing zinc ions present in an amount of about 15 to about 225 g/l and at least one of nickel ions and cobalt ions present in an amount of about 0.5 to about 120 g/l.

14. The bath as defined in claim 13 further including hydrogen ions to provide a pH of about 0 to about 6.5.

15. The bath as define in claim 13 further including hydrogen ions to provide a pH of about 0.5 to about 5.5.

16. The bath as defined in claim 13 further including hydrogen ions or hydroxyl ions to provide a pH of about 6 to about 8.9 and a complexing agent present in an amount sufficient to retain an effective amount of said zinc ions and said nickel and/or cobalt ions in solution.

17. The bath as defined in claim 1 containing zinc ions present in an amount of about 20 to about 100 g/l and at least one of nickel ions and cobalt ions present in an amount of about 4 to about 85 g/l.

18. The bath as defined in claim 1 containing zinc ions and iron ions and further containing hydrogen ions to provide a pH of about 0 to about 6.5.

19. The bath as defined in claim 18 containing hydrogen ions to provide a pH of about 0.5 to about 5.

20. The bath as defined in claim 18 containing hydrogen ions to provide a pH of about 3 to about 6.5 and further containing a complexing agent present in an amount sufficient to retain an effective amount of said zinc ions and said iron ions in solution.

21. The bath as defined in claim 18 containing about 5 to about 140 g/l iron ions.

22. The bath as defined in claim 18 containing about 40 to about 100 g/l iron ions.

23. The bath as defined in claim 18 containing about 2 to about 120 g/l of said zinc ions.

24. The bath as defined in claim 18 containing about 7 to about 75 g/l of said zinc ions.

25. The bath as defined in claim 1 containing 0.5-120 g/l nickel ions and iron ions in combination with 2-120 g/l zinc ions.

26. The bath as defined in claim 1 containing 0.5-120 g/l cobalt ions and 5-140 g/l iron ions in combination with 2-120 g/l zinc ions.

27. The bath as defined in claim 1 containing 5-120 g/l cobalt, nickel and 5-140 g/l iron ions in combination with 2-120 g/l zinc ions.

28. A process for electrodepositing zinc and zinc alloys on a conductive substrate which comprises the steps of contacting a substrate with the aqueous bath as defined in claim 1 and electrodepositing zinc or zinc alloys on the substrate to a desired thickness.

* * * * *